US007744247B2

(12) United States Patent
Zhang et al.

(10) Patent No.: US 7,744,247 B2
(45) Date of Patent: Jun. 29, 2010

(54) LED LAMP HAVING DOUBLE-SIDE HEAT SINK

(75) Inventors: Wen-Xiang Zhang, Shenzhen (CN); Xu-Hua Xiao, Shenzhen (CN); Guang Yu, Shenzhen (CN); Cheng-Tien Lai, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 215 days.

(21) Appl. No.: 11/964,847

(22) Filed: Dec. 27, 2007

(65) Prior Publication Data

US 2009/0168416 A1 Jul. 2, 2009

(51) Int. Cl.
*F21V 29/00* (2006.01)
*F21S 8/00* (2006.01)

(52) U.S. Cl. ..... 362/249.02; 362/294; 362/373; 362/218

(58) Field of Classification Search ..... 362/97.3, 362/249.02, 294, 218, 373, 244
See application file for complete search history.

(56) References Cited

U.S. PATENT DOCUMENTS 4,254,453 A * 3/1981 Mouyard et al. ..... 362/240
4,729,076 A * 3/1988 Masami et al. ..... 362/235
7,244,058 B2 * 7/2007 DiPenti et al. ..... 362/547
7,420,811 B2 * 9/2008 Chan ..... 361/709
7,513,639 B2 * 4/2009 Wang ..... 362/218
2001/0030866 A1 * 10/2001 Hochstein ..... 362/294
2006/0250803 A1 * 11/2006 Chen ..... 362/373
2007/0081338 A1 * 4/2007 Kuan ..... 362/294
2007/0086196 A1 * 4/2007 Wong ..... 362/294
2007/0230185 A1 * 10/2007 Shuy ..... 362/294
2008/0062694 A1 * 3/2008 Lai et al. ..... 362/294
2008/0089071 A1 * 4/2008 Wang ..... 362/294
2008/0158888 A1 * 7/2008 Chen ..... 362/294

FOREIGN PATENT DOCUMENTS

CN 200949771 Y 9/2007
CN 200955716 Y 10/2007
CN 101101102 A 1/2008

* cited by examiner

*Primary Examiner*—Ismael Negron
(74) *Attorney, Agent, or Firm*—Jeffrey T. Knapp

(57) ABSTRACT

An LED lamp includes a heat sink having a base and a plurality of fins extending from the base. A plurality of LED modules is thermally attached to the base of the heat sink. A lamp frame surrounds the LED modules on the heat sink and is hermetically mounted to the heat sink. A lens is hermetically attached to the lamp frame and covers the LED modules. The fins includes a plurality of first fins extending from a first face of the base of the heat sink, and second fins extending from a second face of the base. The LED modules are located between the second fins. A pole has a top end engages with the lamp frame. The pole is used for mounting the LED lamp at a desired position, for example, a sidewalk of a street.

20 Claims, 7 Drawing Sheets

LED LAMP HAVING DOUBLE-SIDE HEAT SINK

BACKGROUND OF THE INVENTION

1. Field of the Invention

The present invention relates to an LED lamp, and particularly to an LED lamp used as an outdoor street lamp.

2. Description of Related Art

LEDs are well known solid state light sources. An LED is a member for transferring electricity to light by using a theory that, if a current is made to flow in a forward direction in a junction comprising two different semiconductors, electrons and cavities are coupled at the junction region to generate a light beam. The LED has an advantage in that it is resistant to shock, and has an almost eternal lifetime under a specific condition; thus, when the LED is used in a lamp, it is intended to be a cost-effective yet high quality replacement for incandescent and fluorescent lamps.

An LED lamp generally requires a plurality of LEDs, and most of the LEDs are driven at the same time, which results in a quick rise in temperature of the lamp. Generally, since the lamps do not have heat dissipation devices with good heat dissipating efficiencies, operation of the lamps has a problem of instability because of the rapid increase of heat. Consequently, the light from the LED lamp often flickers, which degrades the quality of the illumination. Furthermore, the LED lamp is used in a high heat state for a long time and the life time thereof is consequently shortened.

When the LED lamp is used as a street lamp, it is inconvenient to give frequent maintenances to it because of special conditions in respect to the street lamp, for example, location and height of the street lamp and weather condition. Therefore, the LED street lamp needs to be constructed with a reliable heat dissipation capability and robust to withstand severe weather conditions.

SUMMARY OF THE INVENTION

An LED lamp in accordance with a preferred embodiment of the present invention comprises a heat sink having a base and a plurality of fins extending from opposite first and second faces of the base. A plurality of LED modules is thermally attached to the second face of the base of the heat sink, and located between the fins on the second face of the base. A lamp frame surrounds the LED modules on the heat sink and is hermetically secured to the heat sink. A lens is hermetically attached to the lamp frame and covers the LED modules. A pole engages with the lamp frame for mounting the LED lamp at a desired location.

BRIEF DESCRIPTION OF THE DRAWINGS

Many aspects of the present LED lamp can be better understood with reference to the following drawings. The components in the drawings are not necessarily drawn to scale, the emphasis instead being placed upon clearly illustrating the principles of the present LED lamp. Moreover, in the drawings, like reference numerals designate corresponding parts throughout the several views.

DETAILED DESCRIPTION OF THE INVENTION

Figure 1:
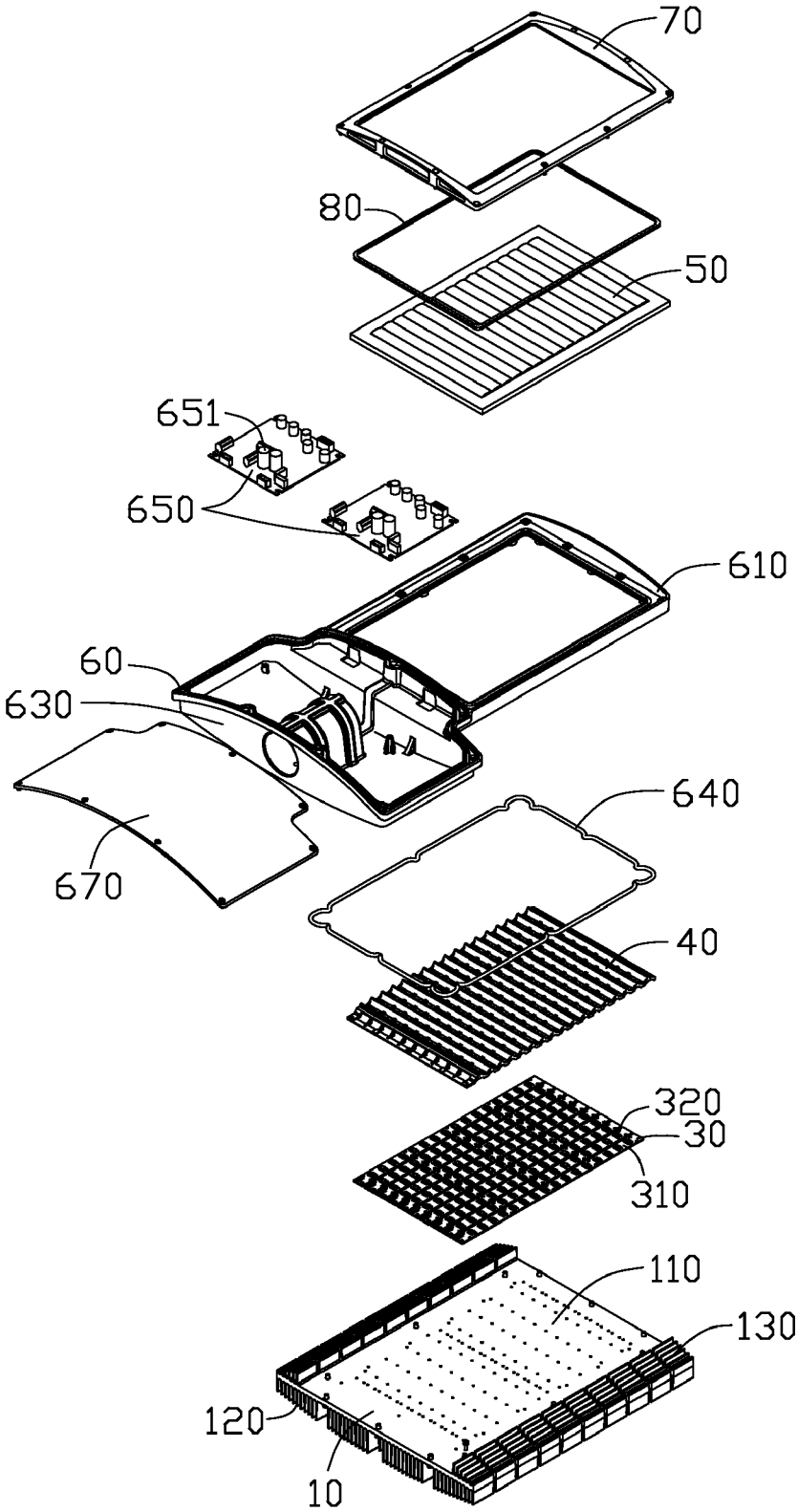
FIG. 1 is an isometric, exploded view of an LED street lamp in accordance with a preferred embodiment of the present invention.
Figure 2:
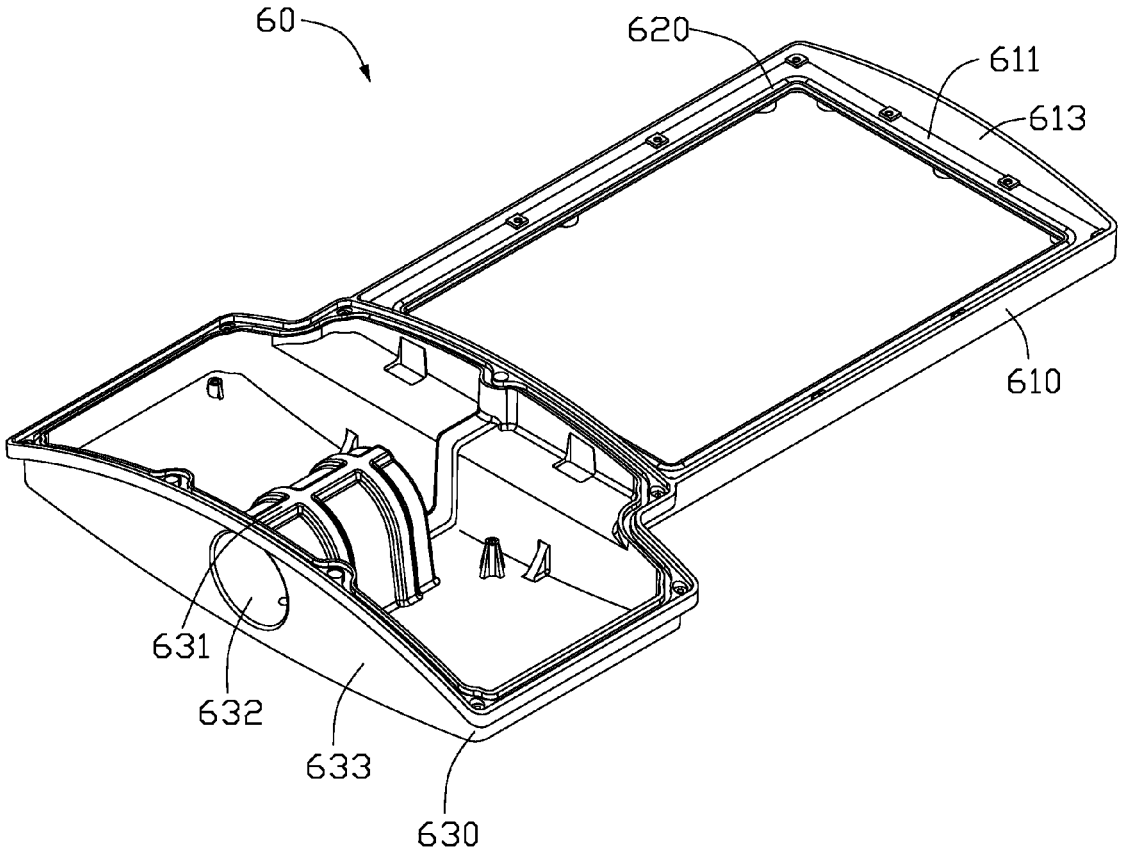
FIG. 2 shows a lamp frame of the LED street lamp of FIG. 1.
Figure 3:
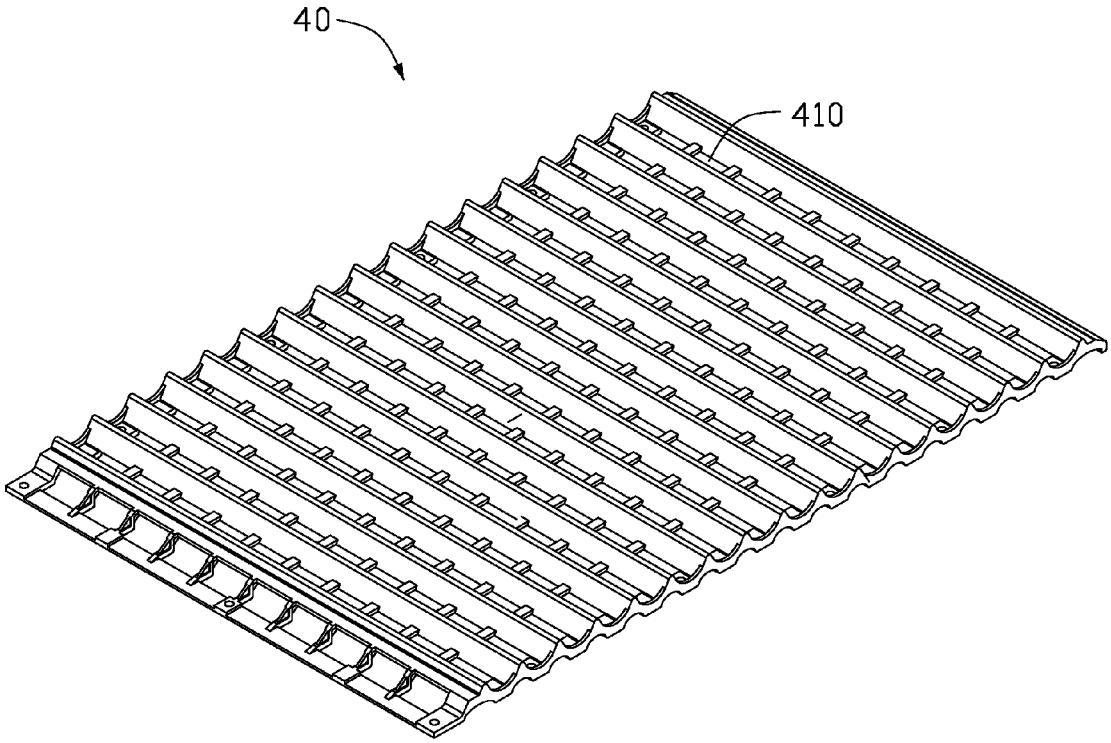
FIG. 3 shows a reflecting board of the LED street lamp of FIG. 1.
Figure 4:
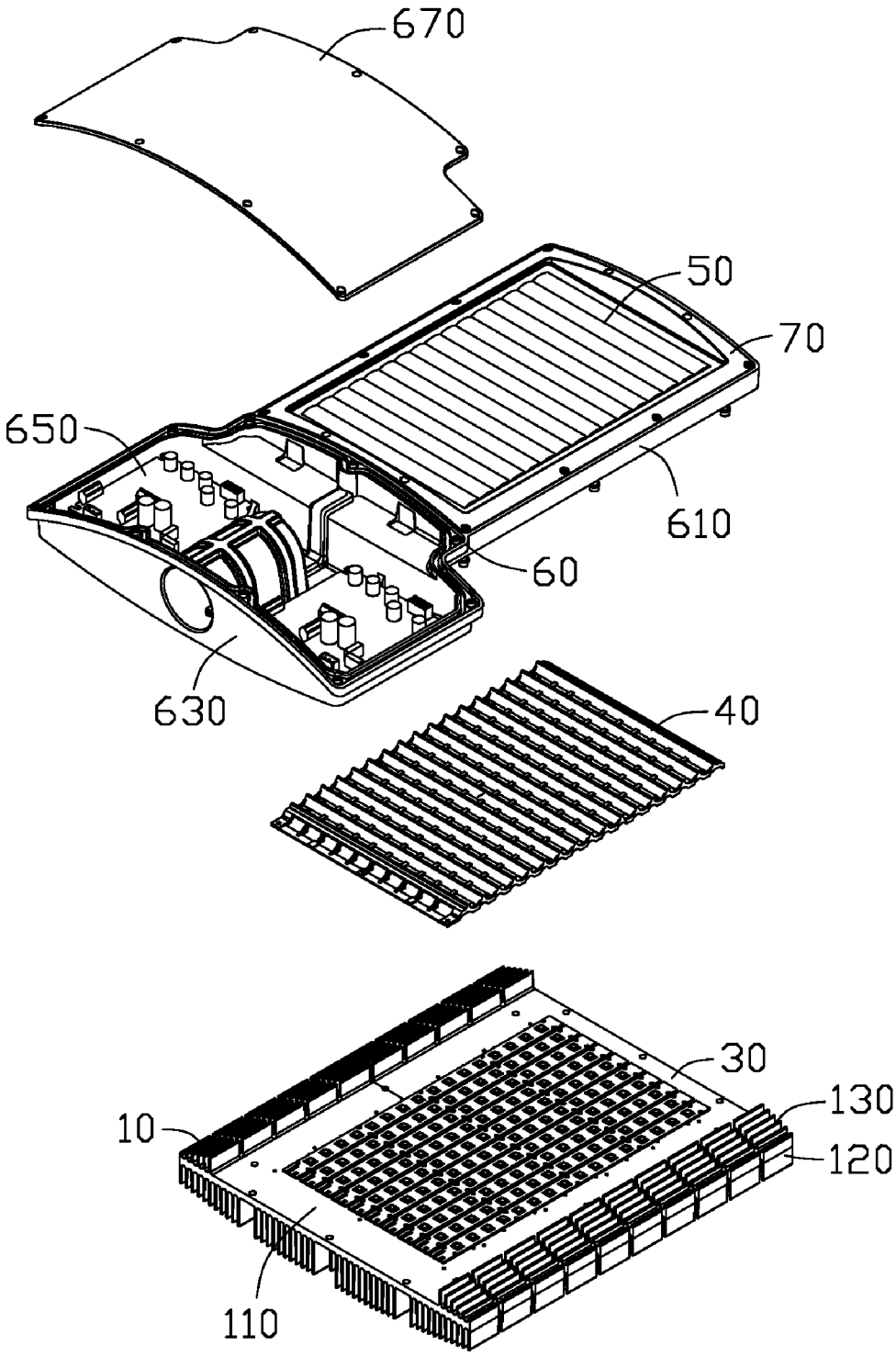
FIG. 4 is a partially assembled view of FIG. 1.
Figure 5:
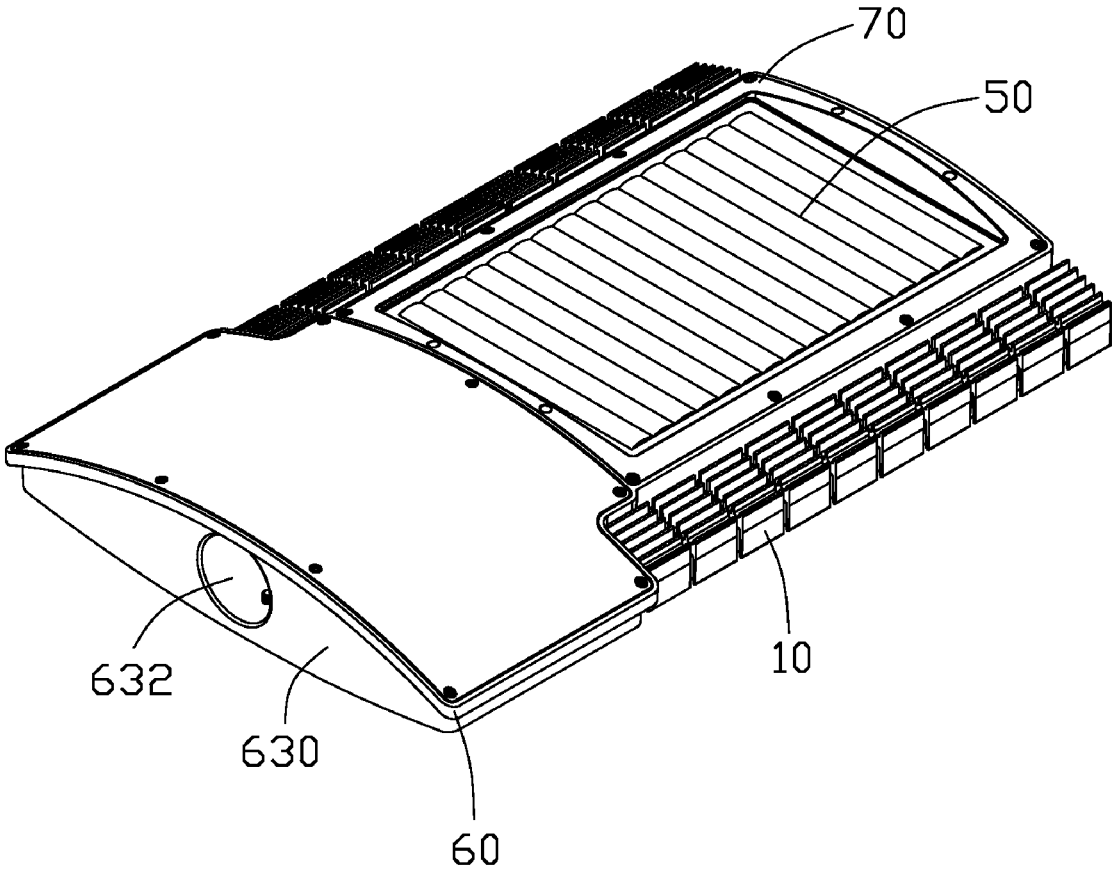
FIG. 5 is an assembled view of FIG. 1.
Figure 6:
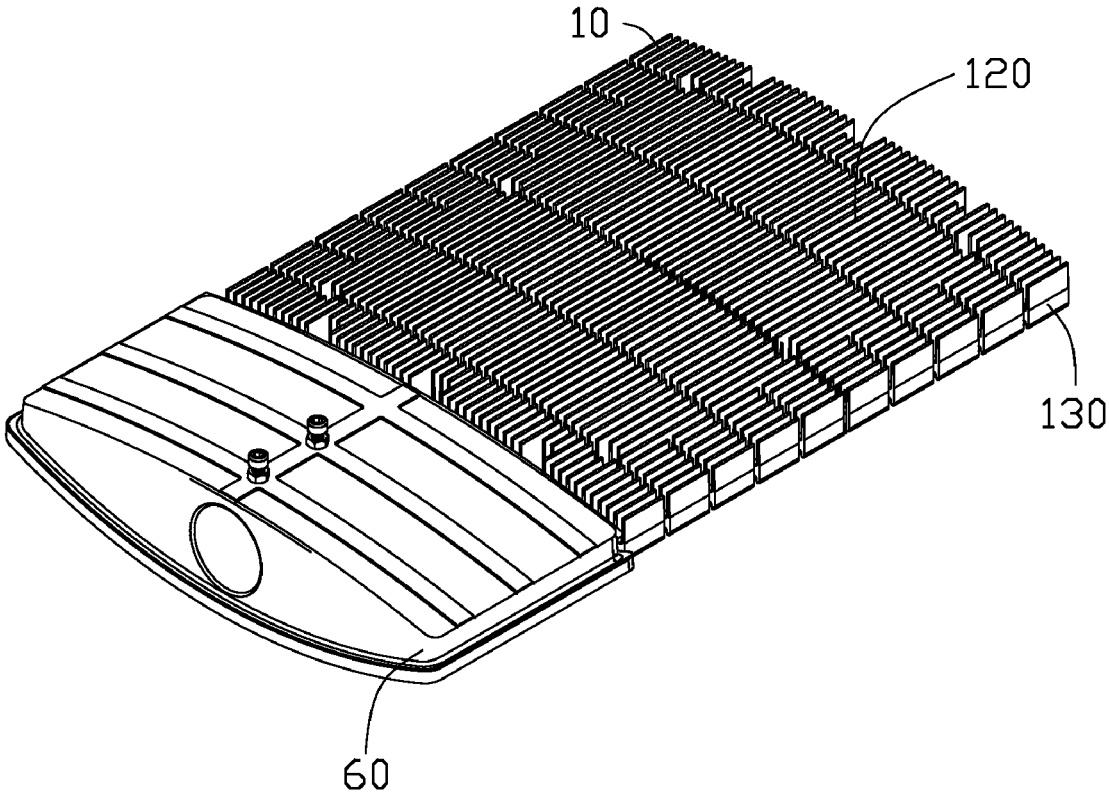
FIG. 6 is a view similar to FIG. 5, from a different aspect.

Referring to FIGS. 1-7, an LED street lamp is shown. The lamp comprises a heat sink 10, a plurality of LED modules 30 thermally attached to a periphery of the heat sink 10, a lens 50 covering the LED modules 30, and a lamp frame 60 with a holding lid 70 holding the LED modules 30 and the lens 50 therein.

The heat sink 10 is integrally formed from one piece metal, and comprises a flat base 110, and a plurality of first fins 120 extending from a first face of the base 110 and a plurality of second fins 130 extending from a second face opposite to the first face of the base 110. The first fins 120 are parallel to each other and are arranged in a plurality of arrays. From two opposite sides to a center of the base 110, the first fins 120 have heights thereof gradually increased, thereby defining an arced top face by top ends of the first fins 120. The second fins 130 are positioned at two opposite lateral portions of the base 110, thereby defining a space therebetweeen for receiving the LED modules 30 therein. The second fins 130 have heights thereof gradually increased from the lateral sides toward the center of the base 110.

LED modules 30 each comprise a circuit board 310 and a plurality of LEDs 320 evenly mounted on the circuit board 310. The LED modules 30 are attached to the second face of the base 110 side by side and between the second fins 130 of the heat sink 10. The LEDs 320 are arranged in a plurality rows and columns on the second face of the base 110. A light reflecting board 40 is positioned over the LED modules 30. In this embodiment, the reflecting board 40 is rectangular and has a size corresponding to the LED modules 30 and defines a plurality of rows of holes 410 corresponding to the LEDs 320 of the LED modules 30. When the reflecting board 40 is positioned to the LED modules 30, the LEDs 320 are received in corresponding holes 410 of the reflecting board 40. Each hole 410 is defined among two opposite partitions (not labeled) and two opposite ribs (not labeled) of the reflecting board 40.

The lamp frame 60 comprises a frame body 610 and a cavity body 630 extending from an end of the frame body 610. The frame body 610 comprises four interconnecting strips 611 at a bottom thereof and four interconnecting sidewalls 613 extending upwardly from corresponding strips 611, wherein two opposite sidewalls 613 each have an arced top side. A top face of the strips 611 defines a first loop groove (not labeled) for receiving a first water-proof gasket 620 therein. A bottom face of the strips 611 defines a second loop groove (not shown) for receiving a second water-proof gasket 640 therein. The cavity body 630 forms an arch bridge 631 in a central portion thereof. Under the bridge 631, an engaging hole 632, extending through a wall 633 of the cavity body 630, is defined for engagingly receiving a top end of a pole 90 therein when the lamp is used. Two driving printed circuit boards 650 are received in the cavity body 630 at two opposite sides of the bridge 631, respectively. A plurality of electronic components 651 are mounted on the printed circuit boards 650. Two lateral sides of the cavity body 630 extend beyond corresponding lateral sides of the frame body 610. An arced cover 670 fitly engages with the cavity body 630 to seal the driving printed circuit boards 650 in the cavity body 630.

The lid 70 is a frame member and has a size corresponding to the frame body 610 of the lamp frame 60.

In assembly, the LED modules 30 are thermally attached to the second face of the base 110 of the heat sink 10. The reflecting board 40 rests on the LED modules 30. The LEDs 320 are received in the corresponding holes 410 of the reflecting board 40. The lamp frame 60 has the frame body 610 resting on the second face of the base 110 of the heat sink 10. The second water-proof gasket 640 hermetically seals a space between the frame body 610 and the second face of the base 110. The cavity body 630 of the lamp frame 60 extends outwardly beyond the heat sink 10. The printed circuit boards 650 are sealed in the cavity body 630 by the cover 670 covering the cavity body 630. The lens 50 rests on the strips 611 of the frame body 610. The first water-proof gasket 620 which is received in the first loop groove of the frame body 610 hermetically seals a space between the lens 50 and the strips 611 of the frame body 610. The lid 70 is mounted on the frame body 610 via a plurality of fasteners such as screws (not shown), to thereby fasten the lens 50 to the frame body 610. A ring pad 80 is sandwiched between the lens 50 and the lid 70 to hermetically seal a space and provide a cushion between lens 50 and the lid 70.

Figure 7:
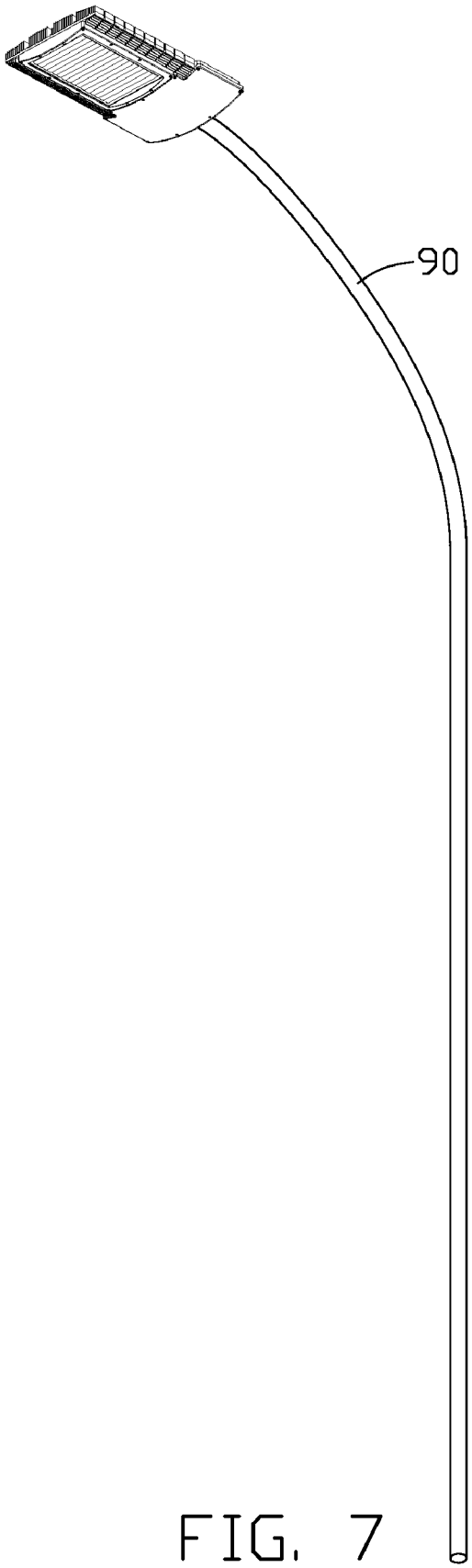
FIG. 7 shows the LED street lamp in a use state.

In use, referring to FIG. 7, the lamp is installed on the pole 90 via the top end of the pole 90 engagingly received in the engaging hole 632 of the lamp. A bottom end of the pole 90 is for being fixed to a stand on a desired position, for example, a sidewalk of a street, whereby the LED lamp in accordance with the present invention can be installed at the sidewalk. When power is given to the LED modules 30, the LEDs 320 light up. The heat generated by the LEDs 320 is absorbed by the base 110 of the heat sink 10 and is dissipated to ambient air by the first fins 120 and the second fins 130.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a heat sink comprising a base and a plurality of fins extending from the base;

a plurality of LED modules thermally attached to the base of the heat sink;

a lamp frame surrounding the LED modules on the heat sink;

a lens attached to the lamp frame and covering the LED modules;

a reflecting board on the LED modules, wherein the LED modules each comprise a printed circuit board thermally contacting the base of the heat sink, and a plurality of LEDs mounted on the printed circuit board, the reflecting board defines a plurality of holes receiving corresponding LEDs therein; and a gasket sandwiched between the base of the heat sink and the lamp frame.

2. The LED lamp of claim 1 further comprising a gasket sandwiched between the lens and the lamp frame.

3. The LED lamp of claim 1, wherein the lamp frame comprises a frame body located on the heat sink and a cavity body extending beyond the heat sink, the cavity body having a printed circuit board located therein.

4. The LED lamp of claim 3, wherein the cavity body has a bridge formed in a central portion thereof, an engaging hole being defined under the bridge for engagingly receiving a pole when the LED lamp is in use.

5. The LED lamp of claim 1 further comprising a lid secured to the lamp frame and fastening the lens to the lamp frame.

6. The LED lamp of claim 5 further comprising a ring pad sandwiched between the lid and the lens.

7. The LED lamp of claim 1, wherein the base of the heat sink has a first face and a second face opposite to the first face, the fins extending from the first face, the LED modules being attached to the second face.

8. The LED lamp of claim 7, wherein the fins of the heat sink have heights thereof increasing from two opposite sides to a center of the base.

9. The LED lamp of claim 7, wherein the heat sink further comprises a plurality of second fins extending from the second face of the base thereof, the LED modules being located between the second fins.

10. The LED lamp of claim 9, wherein the second fins of the heat sink extend from two opposite side portions of the second face of the base.

11. The LED lamp of claim 10, wherein the second fins of the heat sink has heights thereof increasing from corresponding side portions of the second face of the base toward a center of the base.

12. An LED lamp comprising:

a heat sink having a base with opposite first and second faces, a plurality of first fins extending from the first face of the base, a plurality of second fins extending from two opposite sides of the second face;

a plurality of LED modules mounted on the second face of the base of the heat sink between the second fins;

a lamp frame hermetically secured to the heat sink, having a frame body enclosing the LED modules and a cavity body extending from the frame body to a position beside the heat sink;

at least a printed circuit board received in the cavity body;

a lens hermetically mounted on the frame body and covering the LED modules;

a holding lid secured to the frame body to sandwich the lens between the holding lid and the frame body; and a pole having a top end engaging with the cavity body, adapted for mounting the LED lamp on a desired position.

13. The LED lamp of claim 12 further comprising a reflecting board on the LED modules, wherein the LED modules each comprises a printed circuit board thermally contacting the base of the heat sink, and a plurality of LEDs mounted on the printed circuit board, the reflecting board defines a plurality of holes receiving corresponding LEDs therein.

14. An LED lamp comprising:

a heat sink comprising a base and a plurality of fins extending from the base;

a plurality of LED modules thermally attached to the base of the heat sink;

a lamp frame surrounding the LED modules on the heat sink;

a lens attached to the lamp frame and covering the LED modules;

a lid secured to the lamp frame and fastening the lens to the lamp frame; and a ring pad sandwiched between the lid and the lens.

15. The LED lamp of claim 14, wherein the lamp frame comprises a frame body located on the heat sink and a cavity body extending beyond the heat sink, the cavity body having a printed circuit board located therein.

16. The LED lamp of claim 15, wherein the cavity body has a bridge formed in a central portion thereof, an engaging hole being defined under the bridge for engagingly receiving a pole when the LED lamp is in use.

17. The LED lamp of claim 14, wherein the base of the heat sink has a first face and a second face opposite to the first face, the fins extending from the first face, the LED modules being attached to the second face.

18. The LED lamp of claim 17, wherein the fins of the heat sink have heights thereof increasing from two opposite sides to a center of the base.

19. The LED lamp of claim 17, wherein the heat sink further comprises a plurality of second fins extending from the second face of the base thereof, the LED modules being located between the second fins.

20. The LED lamp of claim 19, wherein the second fins of the heat sink extend from two opposite side portions of the second face of the base.

* * * * *